US005810405A

United States Patent [19]

Kettlewood

[11] Patent Number: 5,810,405

[45] Date of Patent: Sep. 22, 1998

[54] LATCHING MECHANISM FOR A GENERATOR FIRE DOOR

[75] Inventor: David Robert Kettlewood, East Greenbush, N.Y.

[73] Assignee: General Electric Co., Schenectady, N.Y.

[21] Appl. No.: 740,739

[22] Filed: Nov. 4, 1996

[51] Int. Cl.[6] ..... E05C 17/44

[52] U.S. Cl. ..... 292/338; 292/DIG. 4

[58] Field of Search ..... 292/338, 262, 292/DIG. 19, 265–267, 271, 273, 274, 277, 278, DIG. 4, DIG. 26, DIG. 66

[56] References Cited

U.S. PATENT DOCUMENTS

| | | | |
|---|---|---|---|
| 1,398,768 | 11/1921 | Burtis | 292/267 |
| 1,615,035 | 1/1927 | Rasmussen | 292/267 |
| 2,056,270 | 10/1936 | Harbert | 292/265 |
| 2,231,885 | 2/1941 | Christy | 292/267 |
| 2,866,659 | 12/1958 | Heiarichs | 292/267 |
| 3,337,253 | 8/1967 | Laukzemis | 292/DIG. 4 |
| 3,917,331 | 11/1975 | Duran | 292/338 |
| 5,355,927 | 10/1994 | McKeon | 160/9 |
| 5,551,740 | 9/1996 | Lin | 292/338 |

OTHER PUBLICATIONS

Drawings No. 109E1212 "Base Assembly" (Interior Door Latch), 1993.

Sketches/photos of field unit (exterior latch, cable operated) in Saudi Arabia (1995–1996) (three sheets of sketches).

*Primary Examiner*—Steven N. Meyers
*Assistant Examiner*—Gary Estremsky
*Attorney, Agent, or Firm*—Nixon & Vanderhye

[57] ABSTRACT

A latching mechanism for a swinging door pivotally mounted on for movement about a first axis between fully open and closed positions includes a support column pivotally mounted for rotation about a second axis parallel to the first axis. One end of the support column is provided with a support block for supporting the door in the open position, and the other end of the support column is provided with a latching bar for securing the support column in a first position where the support block underlies an edge of the door in the open position. A cam surface is provided on the support column, engagable by the door as the door moves from the closed to the open position to rotate the support column and the support block to a position which permits the door to move to a fully open position without interference from the support column or the support block.

10 Claims, 6 Drawing Sheets

LATCHING MECHANISM FOR A GENERATOR FIRE DOOR

TECHNICAL FIELD

This invention relates generally to fire doors and specifically, to a unique latch mechanism which permits remote resetting of a generator fire door.

BACKGROUND

Open ventilated gas turbine generators are provided with fire doors as a means to immediately shut off the flow of air into the gear/load compartment, so that the compartment can be filled with, for example, $CO_2$ gas to extinguish an oil fire. These fire doors are designed to slam shut from inside the compartment, and under their own weight. Typically, after use, at least two workers have been required to reset the door (which is quite heavy), one to hold the door open and the other to reset the associated latching mechanism. This procedure is problematic in that severe injury can occur if the door should happen to slam shut while being latched.

In light of the above, there has been some demand for providing fire doors which can be reset externally of the compartment. One solution, only partially successful, includes the incorporation of a pulley and cable system as a means to externally pull and hold the door open. This arrangement is not completely satisfactory, however, because it still requires another worker to crawl into the generator enclosure to move a support column out of the way so that the door can be opened fully without interference, and so that the latch mechanism can be reset. Accordingly, there remains a need for a new configuration which will permit the door to be reset and latched in the open position from outside the generator compartment, and preferably without completely redesigning the existing latching system.

DISCLOSURE OF THE INVENTION

The present invention provides a latching system which permits reopening and resetting of a door latch mechanism from outside a generator enclosure.

In accordance with an exemplary embodiment of this invention, a generally semi-circular plate has been welded onto the face of the support column. This plate is oriented vertically, extending toward the door when the latter is closed. The plate acts in the nature of a cam surface in that, as the door is closing, a lower edge thereof rides along the arcuate surface of the plate forcing the support column to swing to an out of the way position, thus allowing the door to slam shut under its own weight. When the door is reopened, and with the support column returned to an otherwise interfering position, the lower edge of the door rides along the semi-circular edge of the plate, forcing the support column to swing out of the way. As the door approaches the top of the arcuate cam surface, the support column swings back to a support position, with the reopened door fully supported thereon. At the same time, the support column automatically latches itself in the open position. This position is maintained until, after an alarm is triggered, the latching device is released and the door is free to close in the manner described above.

Accordingly, in its broader aspects, this invention relates to a latching mechanism for a swinging door pivotally mounted on a hinge axis for movement between fully open and closed positions comprising a support column pivotally mounted for rotation about an axis parallel to the hinge axis, one end of the support column provided with a support ledge for supporting the door in the open position, the other end of the support column provided with a latching bar for securing the support column in a first position where the support ledge underlies a lower edge of the door in the open position; and a cam surface on the support column engagable by the door as the door moves from the closed to the open position to rotate the support column and the support ledge to a position which permits the door to move to a fully open position without interference from the support column or the support ledge.

Other objects and advantages of the subject invention will become apparent from the detailed description which follows.

BEST MODE FOR CARRYING OUT THE INVENTION

Figure 1:
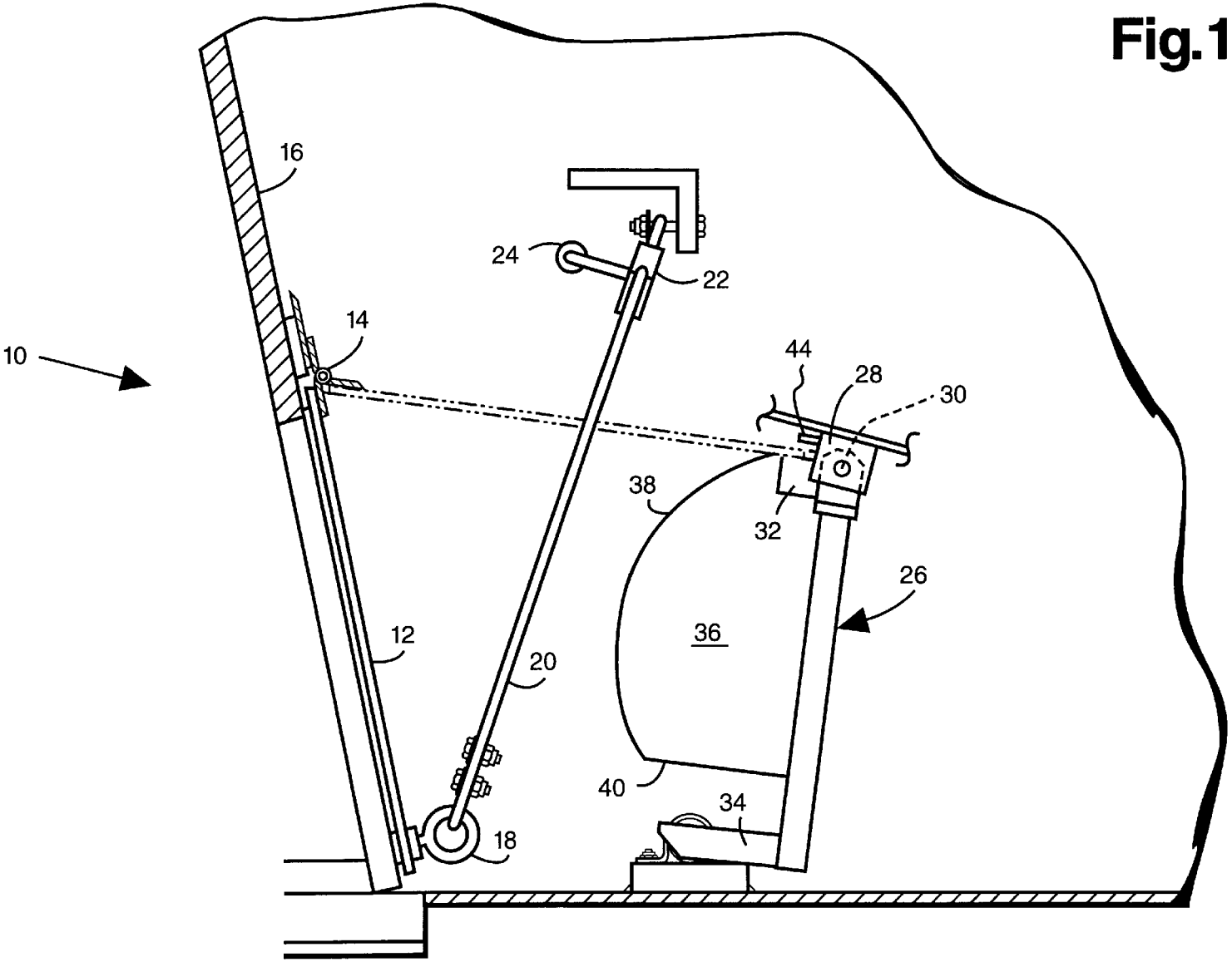
FIG. 1 is a simplified partial side elevation showing a fire door pivotally mounted on a generator enclosure, and in a closed position.

Referring now to FIG. 1, a simplified side view of the generator fire door assembly is shown generally at 10. The door 12 is hinged at 14 to the generator housing wall 16, and is designed to swing inwardly, into the generator compartment when moving from a closed to an open position (the open position is shown in phantom in FIG. 1). The door 12 is provided with an eyebolt 18 at its lower end, the eyebolt receiving a cable 20 which extends upwardly to a support 22 and then exits the housing via an access hole 24. The cable is used to re-open the door 12 after it has shut in response to a fire alarm or other emergency signal. The cable mechanism per se, however, forms no part of this invention and need not be described in detail. It is sufficient to note here that pulling the cable 20 will result in raising the door from the closed position shown in FIG. 1 to the open position shown in phantom, also in FIG. 1.

Figure 2:
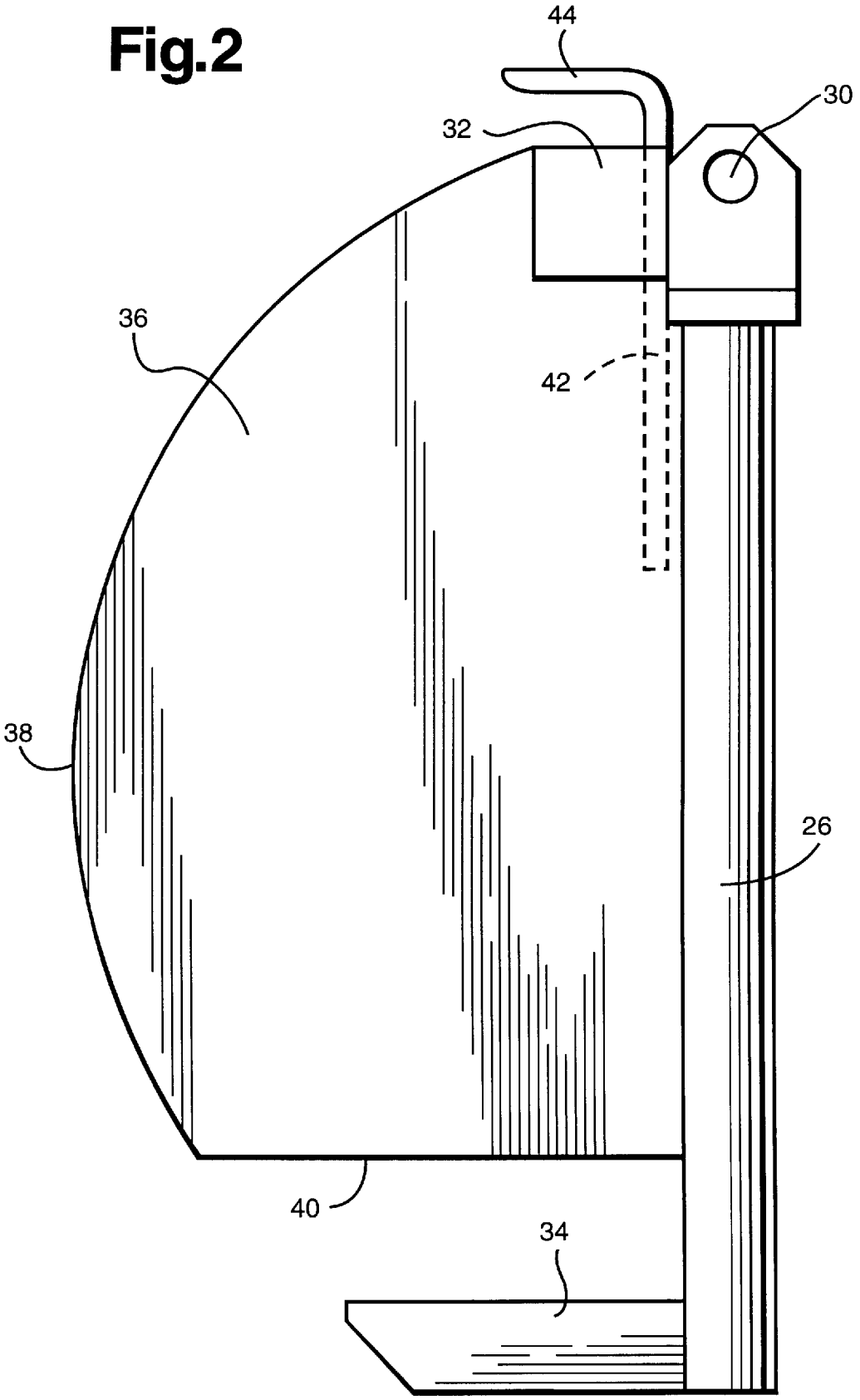
FIG. 2 is an enlarged side elevation of the door support column as shown in FIG. 1.
Figure 3:
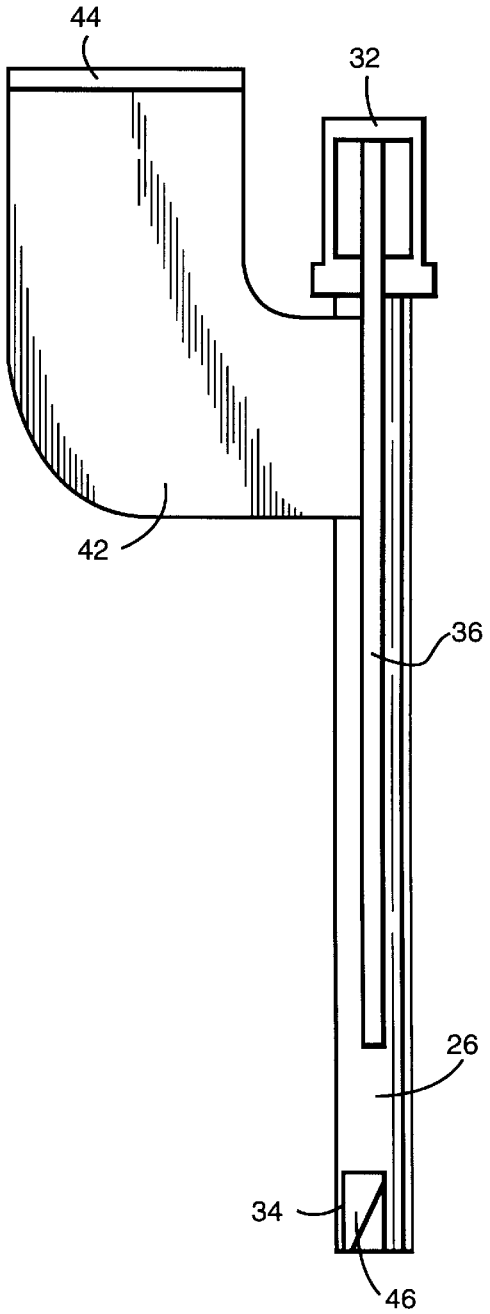
FIG. 3 is a front elevation of the door support column shown in FIG. 2.
Figure 4:
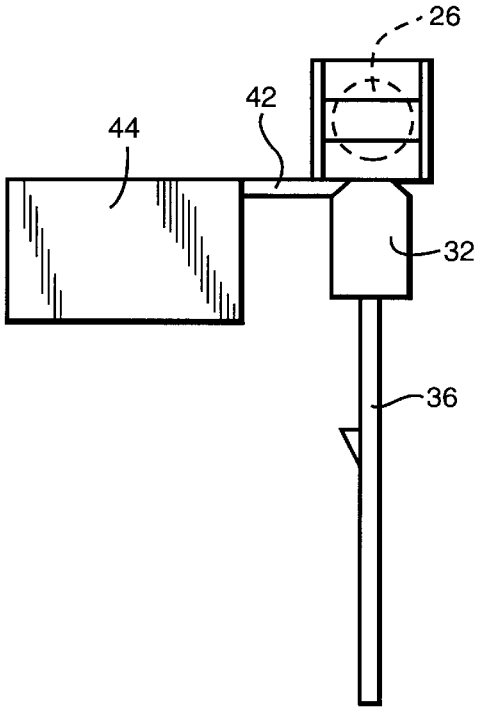
FIG. 4 is a plan view of FIG. 3.

With reference also to FIGS. 2–4, the latching mechanism for the door, includes a door support column 26, pivotally mounted to a frame or beam 28 by pin 30. The upper end of the support column 26 mounts a support block 32 which extends perpendicularly away from the column 26, towards the fire door opening in the generator housing. It is on this support block that the door 12 rests in its open, latched position.

The lower end of the support column 26 is provided with a latch bar 34 which also extends perpendicularly away from the column 26, generally parallel to the block 32. The manner in which the latch bar is utilized to hold the support column 26 with the door 20 in the open position will be described further below.

In accordance with this invention, a radius plate 36 also extends from the support column, generally between the block 32 and latch bar 34. The plate is formed with a radiused surface 38 (preferably about an 8" radius, but this can vary with door size) which extends from the block 32 to a location above and vertically spaced from the latch bar 34, where it terminates at a straight edge 40 which extends parallel to the bar 34. The support column 26 and radius plate 36 are located rearwardly of the door 20 (see FIG. 1) so that the door will engage surface 38 during opening and closing of the door.

The support column 26 also mounts a bracket 42 at its upper end, extending laterally of the column 26 and radius plate 36, with a horizontally oriented stop flange 44 located above and to one side of the support block 32. The stop flange 44 is designed and located to be engaged by the door 20 when the latter is raised to an open position, and to thereby cause the support column to pivot toward its latching position, as also described below.

Figure 5:
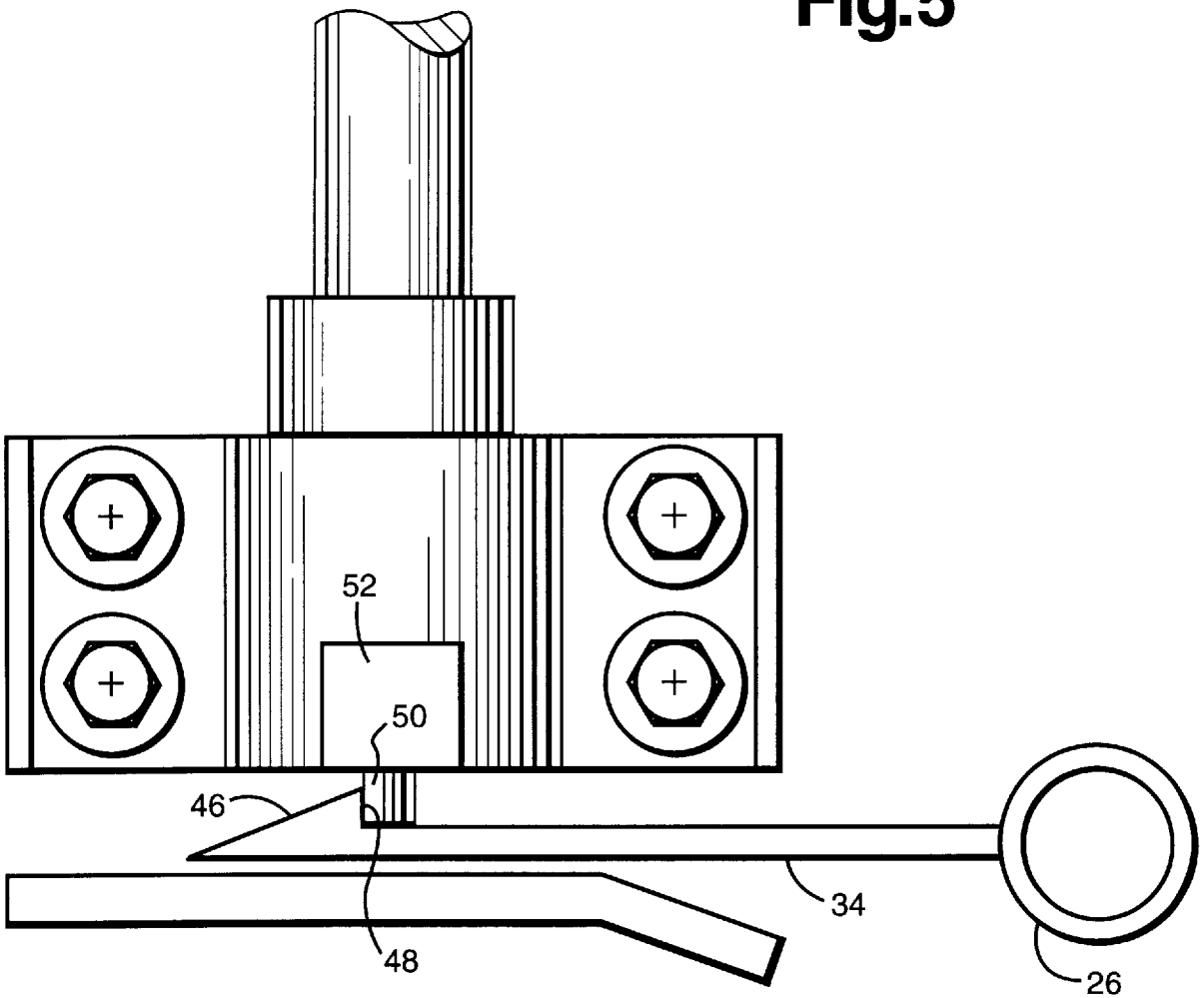
FIG. 5 is a partial plan view of the door latching mechanism as viewed in FIG. 1.

The latching mechanism per se is best seen in FIG. 5. The latch bar 34 is formed with a forward end having an inclined camming surface 46, terminating at a shoulder 48. A latch pin 50 is mounted for axial movement, within a latch housing 52, transversely of the latch bar 34. Thus, as the latch bar moves to the left in FIG. 5 (as it would following reopening of the door, the cam surface 46 is engaged by pin 50 which in turn, is pushed inwardly until the latch bar shoulder 48 passes the pin, allowing the latter to spring back to its fully projected position as shown in FIG. 5. In this position, the support column is prevented from rotating counter-clockwise under the weight of the supported door, in the position shown in FIG. 1.

Figure 6B:
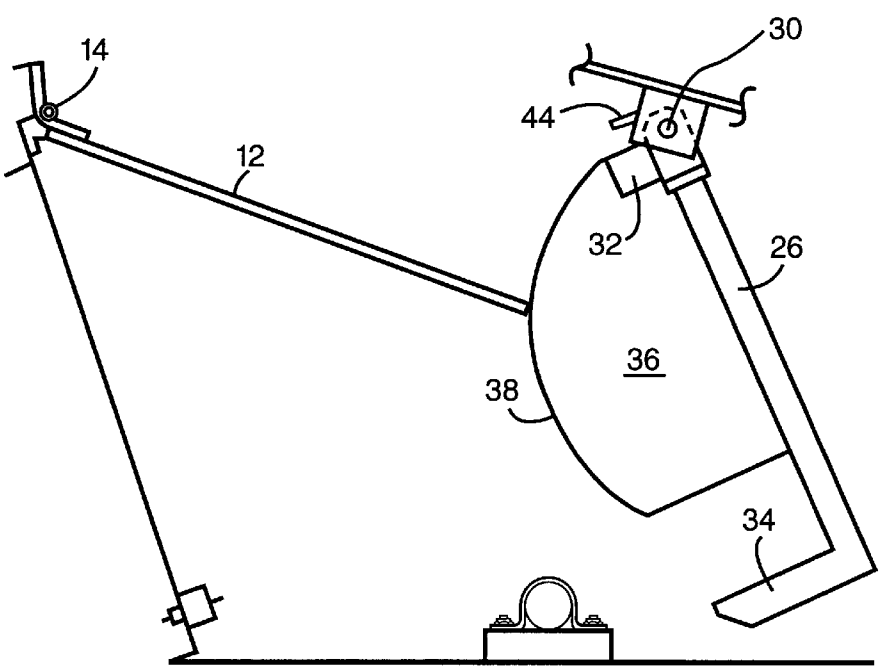
FIG. 6B is one position in a sequence of movements of the door from an open to a closed position, and back toward an open position.
Figure 6A:
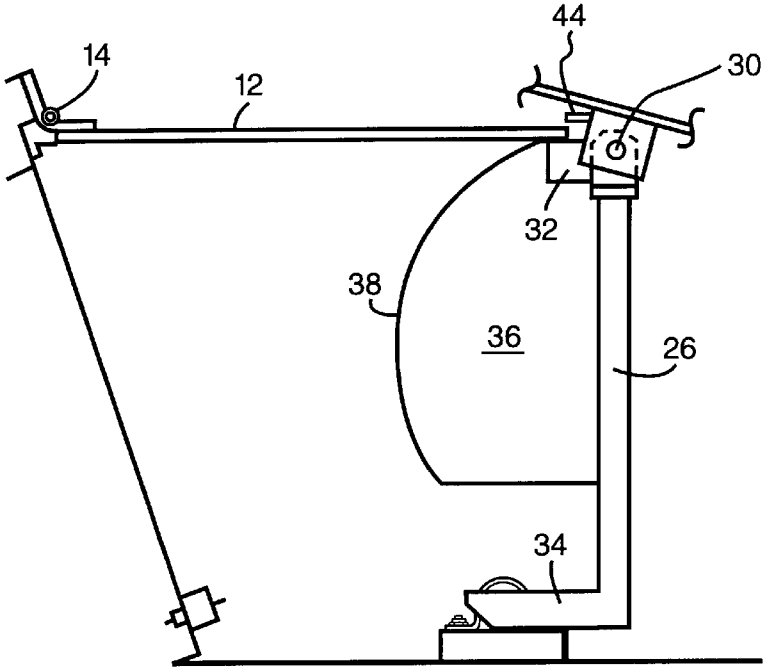
FIG. 6A is one position in a sequence of movements of the door from an open to a closed position, and back toward an open position.
Figure 6D:
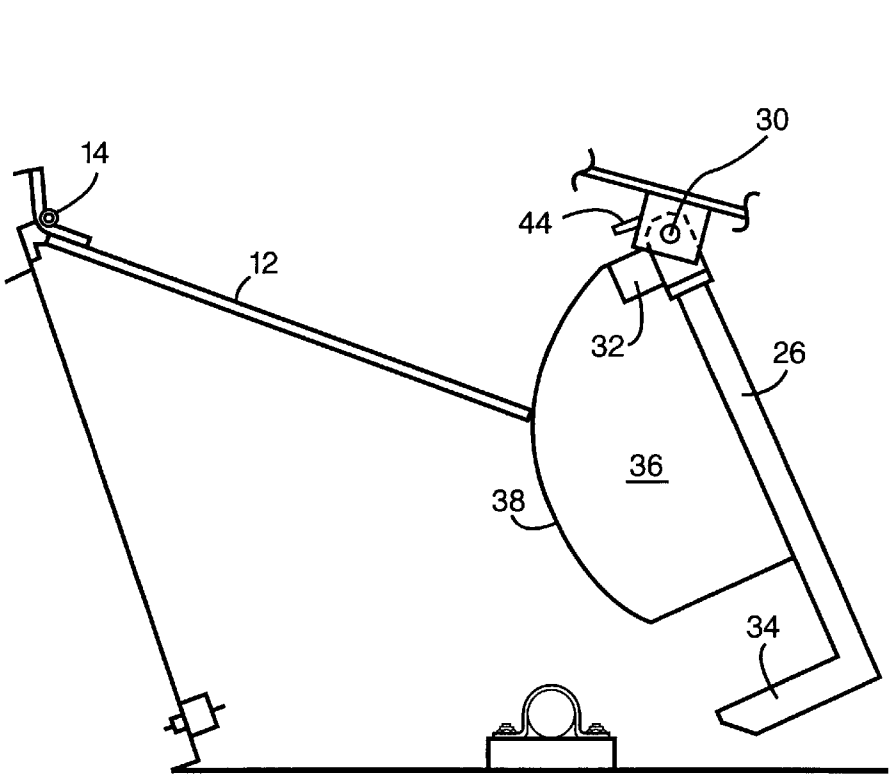
FIG. 6D is one position in a sequence of movements of the door from an open to a closed position, and back toward an open position.
Figure 6C:
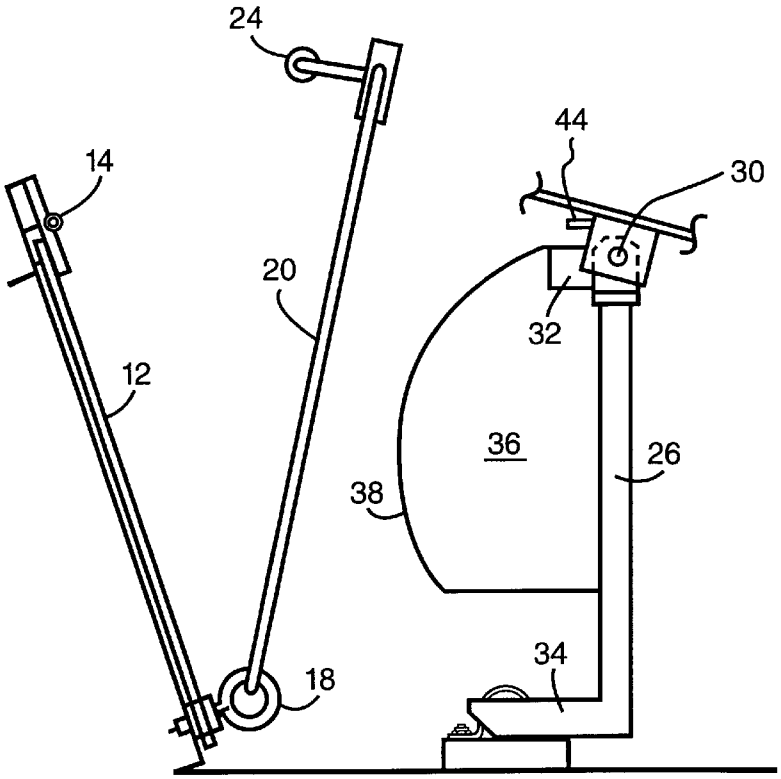
FIG. 6C is one position in a sequence of movements of the door from an open to a closed position, and back toward an open position.

Turning now to FIGS. 6A–6C, the manner of operation of the device will now be described.

FIG. 6A illustrates the generator fire door in an open position, with the lower edge of the door supported by the support block 32. In the open position, the support column 26 is in a position where it has been rotated in a clockwise direction with the latch bar 34 releasably locked in place as described above. This is necessary because, absent the latching mechanism, the weight of the door on the support block 32 (which is laterally offset from the pivot pin 30) would cause the support column 26 to rotate in a counter-clockwise direction about pivot pin 30 to release the door. In this regard, and with reference to FIG. 6B, upon the occurrence of a fire alarm (or other like emergency), the latching pin 50 activated by a suitable sensor and retracted to thereby allow the weight of the door to force the support column 26 to rotate in a counterclockwise direction (see FIG. 1 and FIGS. 6A–6C), with the lower edge of the door sliding along the radiused surface 38. With the door fully closed as shown in FIG. 6C, the support column 26 is then free to relocate itself under its own weight to the position shown in the Figure.

Turning now to FIG. 6D, when the cable 20 (FIG. 1) is utilized to reopen the door 12, the lower edge of the door will engage the radiused surface 38 and cause the support column 26 to rotate in a counterclockwise direction about the pivot 30, while at the same time also rotating the support block 32 out of the way of the door as it returns to its open position. As the lower edge of the door rotates past the relocated support block 32, it engages the stop flange 44. This engagement causes the support column 26 to rotate in a clockwise direction to accomplish two objectives. First, the support block 32 is relocated underneath the door edge to support the door in the open position as shown in FIG. 6A. Second, the latch bar 34 is caused to reengage the locking pin 50 with the pin engaged behind the shoulder 48 at the forward end of the latching bar as shown in FIG. 5. It will be appreciated that as the latching bar moves toward the latching position, the inclined camming surface 46 of the bar 34 initially causes the spring-biased pin 50 to move into the pin housing 52 before it springs back behind the shoulder 48. The fire door is now reset in the open position, ready for automatic closing upon actuation of a fire alarm or other triggering event. The utilization of the radius plate 36 thus eliminates the need for an operator to enter into the generator housing to move the support column to permit opening of the door and to then reset the door in the open position.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A swinging door and a latching mechanism for the swinging door which is pivotally mounted for movement about a first axis between fully open and closed positions the latching mechanism comprising:

a support column pivotally mounted at one end for rotation about a second axis parallel to said first axis, said one end of the support column provided with a support block for supporting the door in the open position, an opposite end of the support column provided with a latching bar for securing the support column in a first position where said support block underlies an edge of the door in the open position; and a cam surface non-rotatably fixed to said support column and engagable by said door as said door moves in one direction from the closed to the open position to rotate said support column and said support block in said one direction to a position which permits said door to move to a fully open position without interference from the support column or the support block.

2. The mechanism of claim 1 wherein said cam surface comprises a curved edge of a plate lying in plane substantially perpendicular to said first and second axes and extending from said support column.

3. The mechanism of claim 2 wherein said plate extends substantially between said support block and said latching bar.

4. The mechanism of claim 1 wherein said latching bar and said support block extend away from said support column in substantially the same direction and substantially parallel with each other.

5. The mechanism of claim 1 wherein said latching bar is releasably held in a latched position when said door is in the open position and wherein, upon release of the latching bar, said door, under its own weight, causes the support column to rotate about said second axis, thereby permitting said door to close.

6. The mechanism of claim 1 and further in combination with a cable for moving the door from the closed to the open position.

7. The mechanism of claim 4 wherein said latching bar is formed with an inclined camming surface and a shoulder engageable with a retractable pin to releasably lock said support column when said door is in the open position.

8. The mechanism of claim 5 wherein said latching bar is formed with an inclined camming surface and a shoulder engageable with a retractable pin to releasably lock said support column when said door is in the open position.

9. The mechanism of claim 5 wherein said support column includes a stop flange located adjacent said support block, adapted to be engaged by said door as said door moves to the open position, thereby causing said support column to rotate in a direction opposite said one direction to said latched position, with said support block underlying said edge of the door.

10. The latching mechanism of claim 1 wherein said curved edge has a substantially constant radius.

* * * * *